US006907981B2

(12) United States Patent
Williamson

(10) Patent No.: US 6,907,981 B2
(45) Date of Patent: Jun. 21, 2005

(54) CONVEYER ASSEMBLY FOR A PRODUCE PACKAGING SYSTEM

(76) Inventor: Robert L. Williamson, 67602 62nd St., Hartford, MI (US) 49057

( * ) Notice: Subject to any disclaimer, the term of this patent is extended or adjusted under 35 U.S.C. 154(b) by 0 days.

(21) Appl. No.: 10/366,637

(22) Filed: Feb. 13, 2003

(65) Prior Publication Data

US 2004/0159527 A1 Aug. 19, 2004

(51) Int. Cl.[7] ..... B65G 29/00

(52) U.S. Cl. ..... 198/459.1; 53/473; 198/465.1; 198/842; 198/631.1

(58) Field of Search ..... 198/459.1, 465.1, 198/631.1, 842; 53/458, 473, 474, 235

(56) References Cited

U.S. PATENT DOCUMENTS 5,307,608 A * 5/1994 Muir et al. ..... 53/440
5,623,815 A * 4/1997 Hornstein et al. ..... 53/472
5,966,906 A * 10/1999 Kuehl et al. ..... 53/435
6,035,610 A * 3/2000 Vonderhorst et al. ..... 53/435
6,296,108 B1 * 10/2001 Grasmueller et al. .... 198/631.1
6,438,928 B1 * 8/2002 Huang et al. ..... 53/473
6,694,706 B1 * 2/2004 Odenthal et al. ..... 53/443

* cited by examiner

*Primary Examiner*—Richard Ridley
(74) *Attorney, Agent, or Firm*—R. Tracy Crump

(57) ABSTRACT

A conveyer assembly used as part of an automated packaging system is disclosed. The conveyer assembly allows the container filling process and produce leveling process to be combined as a single process station in an automated packaging system. The conveyer assembly includes a pair of elastic belts trained about two pulleys, four vibration isolation rollers, and a vibrator mechanism. The vibration isolation rollers are mounted to the frame structure and positioned at incrementally higher positions, which creates a slight incline to the conveyer belts over the first half of the conveyer run. The highest isolation roller, which is located at the center of the conveyer assembly, isolates the first half of the conveyer run from the vibrations generated by the vibrator mechanism. Consequently, the first half of the conveyer run where the produce is deposited into the containers is stable and free from vibration, which reduces the loss of produce due to spillage. The vibration mechanism only affects the second half of the conveyer run where the produce is leveled within the containers.

4 Claims, 2 Drawing Sheets

CONVEYER ASSEMBLY FOR A PRODUCE PACKAGING SYSTEM

This invention relates to automated produce packaging machines for small round produce, such as blueberries, and in particular, a conveyer assembly used in the fill station of an automated produce packaging system, which includes a paddle type vibrator mechanism for leveling produce within a containers, but also isolates the containers from the vibration while the produce is deposited into the containers.

BACKGROUND OF THE INVENTION

U.S. Pat. No. 6,360,787 granted Mar. 26, 2002 to Robert L. Williamson relates a produce packaging machine. This type of automated produce packaging machine is used to package small produce, such as blueberries, in small plastic "clam shell" containers. This type of packaging machine generally consists of a system of conveyers that transport the containers past produce hoppers that meter produce into the containers, vibrators that level the produce within the container, and closure mechanisms that close the lid of the containers.

Heretofore, automated produce packaging systems have suffered from lost produce in the packaging process. Produce is most frequently lost during the filling process where produce metered from the hopper spills out of the containers or during the leveling process before the lids are closed in the packaging process where produce bounces out of the containers or falls between containers moving along the vibrating conveyers. Conventional packaging systems use vibrators to gently shake the conveyers, which levels the produce being piled into mounds in the containers from the hoppers. While the conveyer vibrators are useful and necessary to level the produce in the containers, they contribute to the spillage problem. Often, automated packaging systems use a single conveyer and the vibrations shake all the containers on the conveyer. Because the clam shell containers themselves are so light weight, empty containers traveling on the conveyer toward the hopper are often jarred out of alignment and jam up the packaging process. Container jams lead to lost produce. To eliminate this problem, some automated packaging systems employ separate conveyers, one for the filling station and one for a leveling station. Obviously, using multiple conveyers adds additional cost to the packaging system. In addition, the second conveyers are often run at higher speeds to move the produce through the closure process more quickly. As individual containers pass from the fill station conveyer to the faster vibration conveyers, the containers become spaced apart. With the containers spaced apart, produce again may be lost between the container as the vibrations level the produce. Ideally, a filling process and produce leveling process should use a single conveyer run, but that conveyer run should isolated from vibrations over that portion of the conveyer run where the filling process takes place.

SUMMARY OF THE INVENTION

The conveyer assembly of this invention is used as part of an automated packaging system and allows the container filling process and produce leveling process to be combined as a single process station in an automated packaging system. The conveyer assembly is designed and intended to be incorporated as part of the fill station mechanism of an automated packaging system. The conveyer assembly can be incorporated into a larger complex conveyer network used by a packaging system. The conveyer assembly includes a pair of elastic belts trained about two pulleys, four vibration isolation rollers, and a vibrator mechanism. The vibrator mechanism uses a rotating oblong paddle to create the vibrations in the conveyer belts along the second half of the conveyer run, which levels the produce within the containers. The vibration isolation rollers are mounted to the frame structure and positioned at incrementally higher positions, which creates a slight incline to the conveyer belts over the first half of the conveyer run. The highest isolation roller, which is located at the center of the conveyer assembly, isolates the first half of the conveyer run from the vibrations generated by the vibrator mechanism. Consequently, the first half of the conveyer run where the produce is deposited into the containers is stable and free from vibration, which reduce the loss of produce due to spillage. The vibration mechanism only affects the second half of the conveyer run where the produce is leveled within the containers.

Accordingly, one advantage of the conveyer assembly of this invention is that it combines the filling and leveling functions of the packaging system into a single process station.

Another advantage is that the conveyer assembly incorporates a vibration mechanism that can generate vibrations at higher frequencies and higher amplitudes to level the produce within a container quicker and more efficiently.

Another advantage of this invention is that the conveyer assembly can be used to fill and level produce quicker and over a shorter conveyer run.

Another advantage of this invention is that the conveyer assembly can be shortened in length without losing operational efficiency in the container filling process and the produce leveling process.

Other advantages will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

Figure 1:
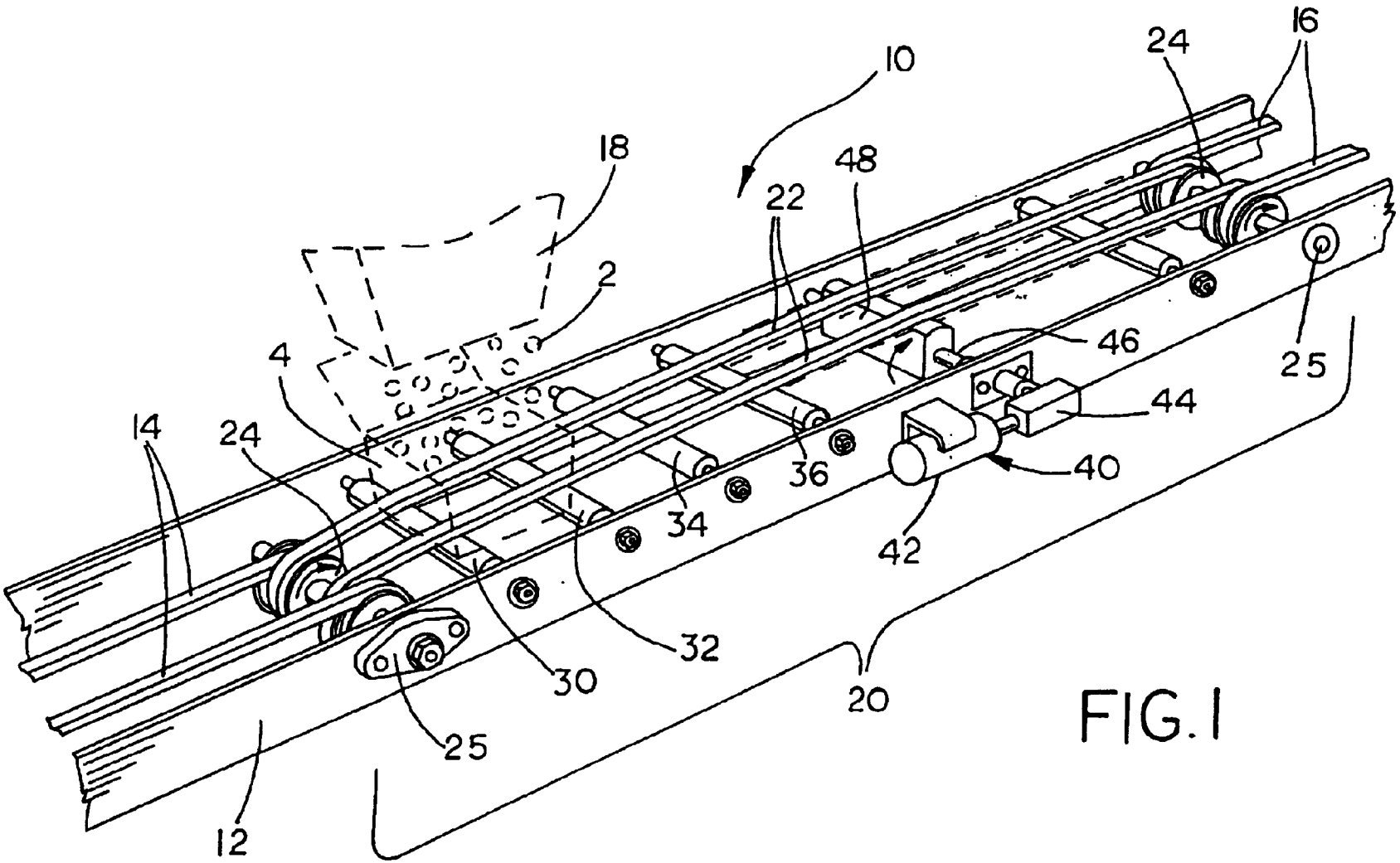
FIG. 1 is a perspective view of the fill station conveyer assembly of this invention illustrated partially as part of a conventional automated produce packaging system.

The preferred embodiment herein described is not intended to be exhaustive or to limit the invention to the precise form disclosed. It is chosen and described to best explain the invention so that others skilled in the art might utilize its teachings.

The fill station conveyer assembly of this invention is designated generally by reference numeral 10 in the figures. Conveyer assembly 10 is illustrated as part of an conventional automated produce packaging system, which processes and packages small round produce, such as blueberries 2, into "clam shell" type containers 4. Generally, clam shell containers are constructed of a clear plastic so that the contents are readily visible to consumers. Containers 4 include a lid and a base receptacle or cup, which are connected by a deformable hinge along adjacent sides thereof.

Automated produce packaging systems incorporate a variety of processing equipment and packaging machinery, such as, container and produce conveyers, container de-nesters, produce sizers, produce hoppers, container closing mechanisms, and various process controls. This type of processing equipment, packaging machinery and controls are well known and need not be described to illustrate the teaching of this invention. Automated packaging systems are generally divided into sub systems or stations that preform a particular process or packaging function. The heart of most automated packaging systems is the fill station, which meters and levels the produce into the containers. A typical fill station includes a produce hopper for metering the produce into the containers and a conveyer mechanism for transporting the container past the hopper.

As shown, conveyer assembly 10 is designed and intended to be incorporated as part of the fill station mechanism of an automated packaging system. The fill station mechanism is designated generally as reference numeral 20. Conveyer assembly 10 is intended to be incorporated into a larger complex conveyer network used by a packaging system. The figures illustrate conveyer assembly 10 integrally and operatively connected to two other conveyer segments 14 and 16, which are employed by the packaging systems. For simplicity of explanation, one skilled in the art can assume that conveyer segments 14 and 16 simply transport containers to and from the fill station from the other processing and packaging stations of the packaging system. Conveyer assembly 10 is built on and into the general frame structure of the packaging system. As shown, the frame structure includes two parallel horizontal beams 12. The frame structure supports conveyer assembly 10, as well as, conveyer segments 14 and 16, and the other equipment and machinery that are employed by the packaging systems. The various conveyer segments generally run the length of the frame structure. A hopper 18 is mounted to the frame structure so that its is suspended over the start of conveyer assembly 10.

Figure 2:
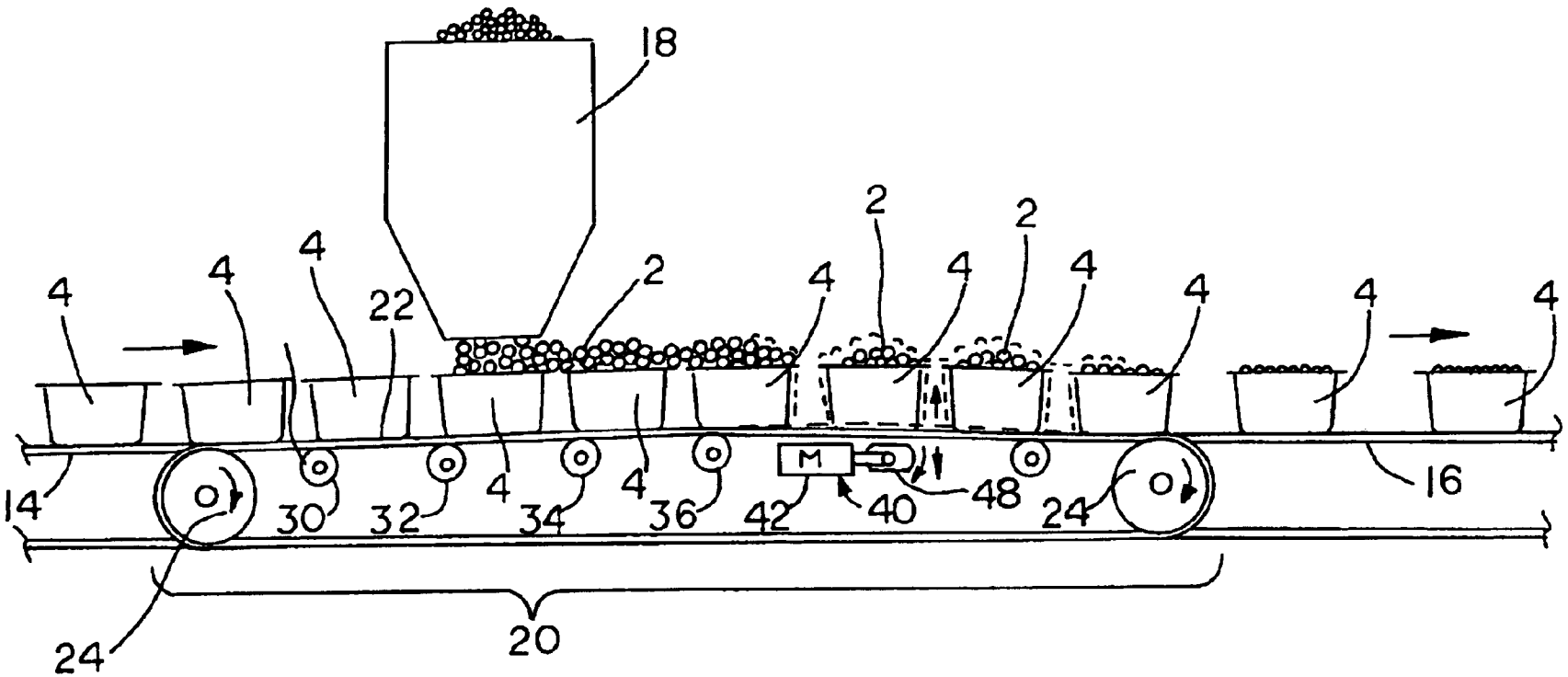
FIG. 2 is a side sectional view of the fill station conveyer assembly of FIG. 1.

As shown in FIG. 1, conveyer assembly 10 includes a pair of elastic belts 22 trained about two end pulleys 24. Pulleys 24 are mounted to shaft and bearing assemblies 25 supported between beams 12. As shown, conveyer assembly 10 is operatively connected between the conveyer segments 14 and 16 by common pulley shaft and bearing assemblies 25. As commonly known in the art, a motor (not shown) is used to turn the drive pulley of one conveyer segment, which in turn drives the other conveyer segments. Conveyer assembly 10 includes four vibration isolation rollers 30, 32, 34 and 36. Rollers 30, 32, 34 and 36 are mounted on a threaded shaft that can be vertically adjusted by hex nuts or other suitable fasteners. As best shown in FIG. 2, the rollers are positioned at incrementally higher positions moving away from hopper 2, which creates a slight rise over the first half of the conveyer run of conveyer assembly 10. Conveyer assembly 10 also includes a vibrator mechanism 40. Vibrator mechanism 40 includes a motor 42, a gearbox 44, drive shaft 46 and oblong paddle 48. As shown, paddle 48 is position underneath conveyer belts 22 so that it intermittently contacts the conveyer belts when rotating. The intermittent contact between rotating paddle 48 and conveyer belts 22 generates a vibration in the conveyer belts that is transmitted to containers 4 to level the produce therein.

It should be noted that the first half of the conveyer run is isolated from the vibrations generated in conveyer belts 22 by vibrator mechanism 40. The progressive rise of the first half of the conveyer run peaks at the tallest isolation roller 36. The contact between conveyer belts 22 and the tallest isolation roller 36 dampens and isolates the first half of the conveyer run from the vibrations generated by vibrator mechanism 40. Consequently, produce is leveled within the containers only over the second half of the conveyer run. It should also be noted that conveyer assembly 10 is approximately twenty-four inches measured between pulleys 24. Also isolation rollers are evenly spaced over the first half of the length of conveyer assembly 10. These dimensions provide sufficient conveyer travel to adequately level the produce over the second half of the conveyer assembly. Over the entire length of conveyer assembly 10, containers 4 are maintained in close side-by-side succession, which reduces produce lost due to spillage between the containers.

Operation

The operation of conveyer assembly 10 and the fill station can now be detailed. As shown in FIG. 2, open containers 4 are transported onto conveyer assembly 10 of the fill station of the automated packaging system in close succession by the first conveyer segment 14. Containers 4 are carried through the fill station along the entire length of conveyer assembly 10 in close side-by-side succession. Containers 4 are positioned in close succession so that no produce is lost between containers as a steady flow of produce is deposited from the dispensing mechanism into the passing containers. Produce 2 is deposited into a tall mounded row of produce in the center of moving container base 6. Moving past hopper 18, produce 2 filled containers 4 pass over rollers 30, 32, 34 and 36. Once past roller 36, produce 2 filled containers 4 are gently shaken by the oscillation of conveyer belts 22, generated by vibrator mechanism 40. The rotation of paddle 48 contacts conveyer belts 22 to create a gentle oscillation that levels the mound of produce 2 within container base 6. The mound of produce within the container is completely leveled as the container moves from conveyer assembly 10 onto conveyer segment 16 for further process and packaging.

Advantages

One skilled in the art will note several advantages of the conveyer assembly used in a fill station of an automated produce packaging systems. The conveyer assembly allows the container filling process and produce leveling process to be combined as a single process station in an automated packaging system. Combining these two functions into one processing station of the packaging systems reduces the overall length and complexity of the conveyer network of the system. Adding the vibrator mechanism to the conveyer assembly eliminates the need for additional separate conveyer segments for a vibrator mechanism. Since the first half of the conveyer run is completely isolated from vibration, the vibrator mechanism can be run at high frequencies and amplitudes to level the produce within the containers without affecting the filling process occurring over the first half of the conveyer run. The design of the conveyer assembly of this invention with the isolation rollers allows a paddle type vibrator mechanism that creates vibrations of higher amplitude and frequencies than the eccentric rollers used by the vibrator mechanisms of conventional packaging systems. Since the produce can be leveled within the containers quicker using higher frequencies and amplitudes of vibrations, the length of conveyer necessary for leveling the produce is reduced. As a result, the overall length of the conveyer assembly of this invention is much shorter than conventional conveyer assemblies. In fact, the entire conveyer assembly can be reduced to under three feet of linear space.

Isolating the vibrations which level the produce within the containers to only the first half of the conveyer run also reduces the problem of lost produce due to spillage in the filling process experienced by conventional packaging systems. The vibrator mechanism operates only over the second half of the conveyer run. The slight incline of the first half of the conveyer run created by the raised isolation rollers dampens and eliminates any vibrations in the conveyer belts over the first half of the conveyer run. Over the first half of the conveyer run, the containers move steadily past the hopper where they are filled with produce in complete isolation of vibration. Over the second half of the conveyer run, the containers are gentle shaken by the oscillation of the conveyer belts, which levels the produce within the containers.

It should also be noted that no produce is lost between the containers passing through the fill station. The conveyer assembly transports all of the containers at a constant rate and in close side-by-side succession, which ensures that produce does not fall between the containers. The produce is completely leveled within the containers by the time they leave the conveyer assembly.

It is understood that the above description does not limit the invention to the details given, but may be modified within the scope of the following claims.

I claim:

1. A conveyer assembly used in a fill station of an automated produce packaging system for packaging produce into containers, the conveyer assembly comprising:

a frame, a first conveyer pulley and a second conveyer pulley each supported by the frame and horizontally spaced from each other, a conveyer belt trained about the first pulley and the second pulley to form a top conveyer run upon which the containers travel in close side-by-side succession, drive means for propelling said conveyer belt about the first conveyer pulley and the second conveyer pulley, a roller supported by the frame between the first conveyer pulley and the second conveyer pulley, the roller contacts the conveyer belts so that the top conveyer run has an incline between the first pulley and the roller, the roller constituting means for isolating vibrations imparted to the conveyer belt over the top conveyer run between the first conveyer pulley and the roller, and vibration means mounted to the frame between the roller and the second conveyer pulley for imparting vibration to the conveyer belt to level produce deposited into a container from the hopper.

2. The conveyer assembly of claim 1 wherein vibration means includes a rotatable oblong paddle mounted to the frame so as to intermittently contact the conveyer belt, and a motor operatively connected to the paddle to rotate the paddle.

3. An automated produce packaging system for packaging small round produce into containers, the system comprising:

a frame, a hopper supported by the frame for metering produce into the containers, and a conveyer assembly supported by the frame for transporting the containers in succession past the hopper, the conveyer assembly includes a first conveyer pulley and a second conveyer pulley each supported by the frame and horizontally spaced from each other, a conveyer belt trained about the first pulley and the second pulley to form a top conveyer run upon which the containers travel in close side-by-side succession, a roller supported by the frame between the first conveyer pulley and the second conveyer pulley, the roller contacts the conveyer belts so that the top conveyer run has an incline between the first pulley and the roller, the roller constituting means for isolating vibrations imparted to the conveyer belt over the top conveyer run between the first conveyer pulley and the roller, and vibration means mounted to the frame between the roller and the second conveyer pulley for imparting vibration to the conveyer belt to level produce deposited into a container from the hopper.

4. The conveyer assembly of claim 1 wherein vibration means includes a rotatable oblong paddle mounted to the frame so as to intermittently contact the conveyer belt, and a motor operatively connected to the paddle to rotate the paddle.

* * * * *